US007836652B2

(12) United States Patent
Futterman

(10) Patent No.: US 7,836,652 B2
(45) Date of Patent: Nov. 23, 2010

(54) SYSTEM AND METHOD FOR SEALING JOINTS BETWEEN EXTERIOR WALL PANELS

(75) Inventor: Sanford Lloyd Futterman, 811 Mariner, Lakeway, TX (US) 78734

(73) Assignee: Sanford Lloyd Futterman, Lakeway, TX (US)

( * ) Notice: Subject to any disclaimer, the term of this patent is extended or adjusted under 35 U.S.C. 154(b) by 0 days.

(21) Appl. No.: 12/586,096

(22) Filed: Sep. 17, 2009

(65) Prior Publication Data

US 2010/0071292 A1 Mar. 25, 2010

Related U.S. Application Data

(60) Provisional application No. 61/192,763, filed on Sep. 22, 2008.

(51) Int. Cl.
*E04B 2/00* (2006.01)

(52) U.S. Cl. ..... 52/417; 52/393; 52/741.4; 52/741.41; 52/459; 52/396.04

(58) Field of Classification Search ..... 52/417, 52/393, 741.4, 741.41, 459, 396.04; 524/158; 156/71, 94, 574, 575; 427/140, 258, 288, 427/407.1, 419.1, 419.2, 419.7
See application file for complete search history.

(56) References Cited

U.S. PATENT DOCUMENTS

| | | | | |
|---|---|---|---|---|
| 4,313,991 | A * | 2/1982 | Lamb | 428/131 |
| 5,037,686 | A * | 8/1991 | Conboy | 428/43 |
| 5,486,394 | A * | 1/1996 | Stough | 428/61 |
| 7,159,368 | B2 * | 1/2007 | Peng | 52/393 |
| 2008/0176469 | A1 * | 7/2008 | Dong et al. | 442/58 |

* cited by examiner

*Primary Examiner*—Richard E Chilcot, Jr.
*Assistant Examiner*—Mark R Wendell
(74) *Attorney, Agent, or Firm*—Global Coatings, Inc

(57) ABSTRACT

Buildings and walls are commonly constructed with exterior walls composed of specially treated engineered wood panels, cement panels, fiber cement panels, glass-matt-faced gypsum panels, and gypsum/cellulose sheathing panels. The spaces or edges between these exterior panels are sealed using the disclosed dual-tape-core joint treatment system and method of the present invention. After curing, a color matching acrylic-epoxy scratch coat or elastomeric primer followed by a textured finish coat is sprayed, brushed or rolled on the exterior panels.

11 Claims, 1 Drawing Sheet

SYSTEM AND METHOD FOR SEALING JOINTS BETWEEN EXTERIOR WALL PANELS

CROSS REFERENCE TO RELATED APPLICATION

Figure 1:
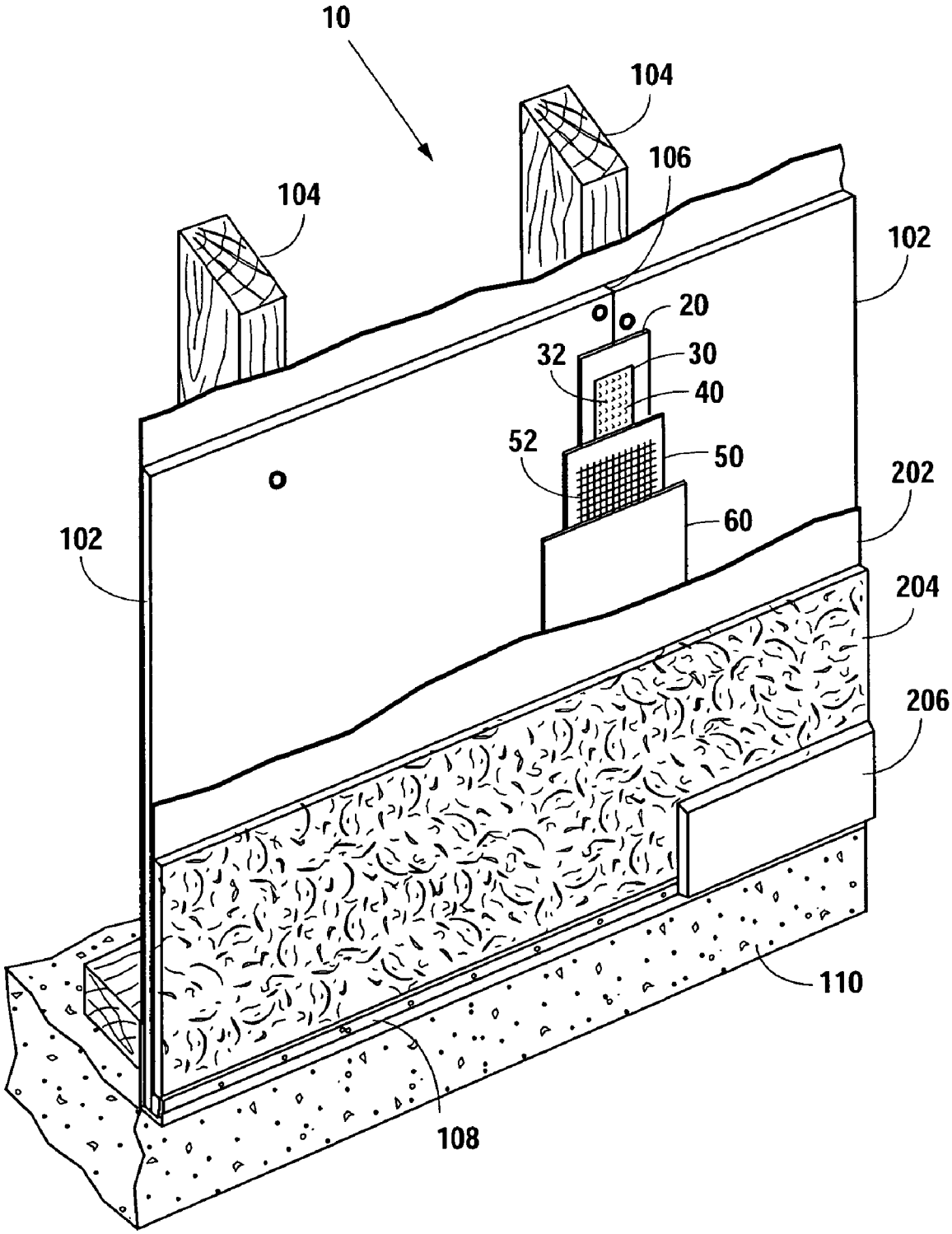

This application claims the benefit of Provisional U.S. Patent Application No. 61/192,763 filed Sep. 22, 2008.

STATEMENT REGARDING FEDERALLY SPONSORED RESEARCH OR DEVELOPMENT

The invention described in this patent application was not the subject of federally sponsored research or development.

FIELD

The present invention relates to an improved system and method for sealing the spaces between exterior wall panels fastened to building frames to allow for the application of paint, a synthetic stucco finish or other coatings and covering on the exterior wall panels.

BACKGROUND

Stucco finishes are an example of an exterior finish that has been used since ancient times. Still widely used throughout the world, stucco exterior finishes make up one of the most common ways of finishing exteriors of both residences and commercial buildings.

Like interior wall plaster, stucco has traditionally been applied on exterior surfaces as a multiple-layer process, sometimes consisting of one, two, but more commonly as three coats. Whether applied directly to a masonry substrate or onto wood with a metal lath, the process of applying stucco includes the step of applying a first "scratch" or "pricking-up" coat, followed by a second coat, sometimes referred to as a "floating" or "brown" coat, followed finally by the "finishing" coat. Up until the late-nineteenth century, the first and the second coats were of much the same composition, generally consisting of lime, portland cement, sand, perhaps clay and one or more other natural additives. Straw or animal hair was usually added to the first coat as a binder.

The third, or finishing coat, consisted primarily of a very fine mesh grade of lime and sand, and sometimes a color pigment.

Although traditional stucco finishes have been used on building exteriors for quite some time, traditional stucco finishes have their limitations. Those limitations include porosity, rigidity, freeze/thaw fractures, fungal and mildew formation, cracking, complexity of installation, high maintenance and the requirement for a specialized skilled labor pool to properly apply the stucco finish so that it will both look good and withstand the effects of weather.

Because modern synthetic stucco finishes are watertight, any water that remains trapped behind these modern synthetic stucco finishes does not readily evaporate. The trapped water behind the stucco finish can then soak into the substrata and framing of the building. The water that soaks into the substrata and framing often causes severe damage to the building without any signs of damage appearing on the exterior of the building. These problems can exist regardless of the age of the building or the quality of construction. Another problem leading to severe damage is insulation cladding. Specifically, insulation cladding is unforgiving for water penetration or condensation. Moreover, the durability of the cladding itself is prone to penetration by abrasion, birds, insects and airborne debris.

Although modern synthetic stucco finishes are attractive and long lasting, their usefulness is compromised by the integrity of the foundation to which it is applied. It has been found that one of the most durable foundations for a direct applied synthetic stucco finish is formed by either engineered treated wood panels, cement panels or fiber cement panels affixed either to the exterior sheathing or directly to the building frame.

The recent introduction of engineered treated wood panels, cement panels, and fiber-cement panels, available in 4-foot widths by various lengths and thickness, has provided an opportunity to replace prior art stucco systems with a pre-formed exterior wall panel that can be installed like wood paneling or interior drywall panels. However, just like interior drywall panels, exterior wall panels, when installed, have seams or joints between each panel that must be filled so that a smooth exterior finish may be applied.

To create a pleasing and uniform appearance for the exterior of a building, the outline of each wall panel should be invisible. For interior drywall panels, hiding the outline of each panel is achieved by tapering the edges of the panels so that when the drywall panels abut one another, the tapered edges provided a channel suitable for the use of tape and mud to hide the resulting seams. The process of first taping and then placing mud over the tape creates a smooth transition between panels. Unfortunately, unlike interior drywall panels with their tapered edges, exterior wall panels typically lack tapered edges and do not form a channel which is easily filled and masked. Hence, when exterior wall panels are placed along side one other on the exterior of a building, a butt-joint with square edges is created. This butt-joint between the exterior wall panels is difficult to disguise. In addition, the edges of each wall panel are subject to the stresses of building movement, temperature changes and other environmental factors. Accordingly, the foregoing factors must be considered when finishing an exterior wall so that no seams or joints between exterior wall panels are visible.

One prior art solution, described in U.S. Pat. No. 6,516,580, teaches simply filling the gaps between exterior fiber cement panels with a polyurethane caulk. The polyurethane caulk is then covered with a 3-inch wide, peal and stick butyl-rubber tape having a fabric backing. This butyl-rubber tape and the rest of the panel is then coated with an exterior synthetic stucco finish coat. This solution has proven to be unsatisfactory because it overlooks the problems of out-gassing from the polyurethane caulk. Specifically, if the polyurethane caulk isn't fully cured due to time or climate constraints and is then covered by a non-permeable butyl rubber tape, the emission of gas from the polyurethane caulk causes blisters or ridges to form as the trapped gas tries to escape (out gas) from the polyurethane caulk. In addition, there is also a tendency for the butyl-rubber tape to "blister" if any air becomes trapped while handling and applying the butyl-rubber tape to the panel. Furthermore, the butyl-rubber tape is extremely tacky and has a tendency to stick to itself during application creating a tenting effect that bulges outwardly from the butt-joint between the exterior wall of the fiber cement panel. Moreover, peel & stick tapes have a tendency not to stick well in in cold or freezing temperatures as well as to edge creep causing visible cracks to telegraph through to the stucco finish outlining the edges of the peel and stick tape.

The prior art approach of placing butyl-rubber tape over a polyurethane caulk overlooks the problem presented by a butt-joint between exterior fiber cement panels. By sealing the polyurethane caulk with a butyl-rubber tape, an elevation is created at the seams between the fiber cement panels. This elevation accentuates the outline of the panels. Flexibility at the butt-joint between the fiber cement panels is then compromised. To address the problem of accentuating rather than hiding panel outlines, applicators have attempted to place multiple layers of stucco over the exterior fiber cement panels. These multiple layers of stucco increase the material and labor cost. Moreover, any irregularities still evident after the stucco finish is applied will be very difficult, if not impossible, to hide. Accordingly, there still remains a need in the art for a system and method for filling the space between exterior wall panels that provides a smooth appearance for painting or the application of a stucco finish.

Another prior art patent, U.S. Pat. No. 7,159,368, also describes the use of an elastomeric joint tape made with an elastomeric backing material, with the option of an optional release liner laminated to the adhesive.

Further research has revealed the potential for hairline cracks at joints and seams given the issues of building settlement, stud movement, incorrect panel nailing and attachment, and other problematic construction practices. Upon further study, it was also determined that the over-application of ceramic spackle such as the Fill-N-Build product marketed by Global Coatings, Inc. at panel field joints could also contribute to hairline cracking. Moreover, the use of a reinforced joint tape along a mastic such as the AcraCream product marketed by Global Coatings, Inc. as the sole factor to seal, waterproof and manage joint movement could be improved. Given the soft flexible nature of the mastic, the joint tape and a primer such as the ColorFlex product marketed by Global Coatings, Inc., tethered by direct interface to relatively hard synthetic stucco finish such as the Carrara product marketed by Global Coatings, Inc., the potential for hairline cracks in the synthetic stucco finish would be enhanced by the flexing of the relatively softer and more flexible joint treatment components. It became clear that given the wide issues of building envelope movement as well as freeze/thaw associated with weathering, there remains a need in the art for a more forgiving and accommodating joint treatment system to provide a basis for the creation of a true non-cracking finish and stucco system usable on various types of exterior wall panels.

SUMMARY

Contrary to all prior art that describes a single elastomeric tape for panelized wall systems, the disclosure of the present invention describes the evolution of a joint treatment system utilizing two tapes. The first tape is a foundation tape that is semi-rigid but flexible and forms a platform to bridge open joints and seams. The second tap is an elastomeric sealing finish tape that is over laid of the foundation tape. Mastic is used between both tapes to encapsulate both tapes. The mastic is a high tensile, elastomeric sealing compound. Not unlike a skeleton with soft surrounding tissue that provides both form and function, the coupling of a stiff inner foundation tape with a soft exterior finish tape, laminated with an elastomeric sealing compound, together form the joint treatment invention disclosed and described herein as a dual-tape-core technology.

The present disclosure provides for panelized wall systems constructed with a dual-tape-core joint treatment system and methods of their use and manufacture. The disclosed panelized wall systems have both semi-rigid and elastomeric tapes laminated with a high tensile elastomeric mastic. The dual-tape-core technology disclosed herein is constructed using two individual tapes applied in linear order in the field or may also be manufactured in duality with the properties of each tape pre-laminated together for the benefit of application as a single tape in the field.

Accordingly, the disclosed invention is a method of constructing a panelized wall system, including the following steps: positioning at least two building panels to a frame, wherein each panel has a front surface, a back surface, and a plurality of edges, the back surfaces of the panels are positioned over the frame, and the two panels are positioned adjacent to each other, forming a seam between the adjacent panels; fastening the building panels to the frame; forming a dual-tape-core joint, which includes a waterproof filler and sealer of mastic applied with a putty knife to the panel butt joint, laying the foundation tape into the mastic applied to the seam between the adjacent panels, wherein the foundation tape is a polyvinyl-chloride (PVC) tape in which the ability of the PVC tape to adhere to a taping compound is enhanced by gluing cotton or synthetic fibers to the surface of the PVC tape. Further mechanical bond adherence to the taping compound is developed through the use of perforations in the foundation tape allowing the taping mastic to ooze through and encapsulate the foundation tape. A second layer of mastic is then applied with a putty knife over the foundation tape that smoothes and feathers the first pass of mastic over the foundation tape and provides a base for the wider but thinner finish tape to cover and seal the underlying foundation tape. The finish tape is also encapsulated by the mastic and the mastic is feathered past the edges of the finish tape to create a flat wall.

The frame is a wood or metal stud frame. The frame may or may not include shear panels. The frame comprises a moisture barrier. The exterior wall panels may be engineered wood treated with zinc borate or other chemical additives designed to resist the effects of termites and fungal decay and may feature an overlay, pre-primed surface and have either tapered edges, square edges or ship-lap edges such as Smartside Precision Panel and Trim sold by Louisiana Pacific. The exterior wall panels may be glass mat reinforced cement panels such as the Perma Base product sold by National Gypsum, fiber cement panels such as the Hardie Panel sold by James Hardie, glass mat reinforced gypsum boards such as the Dens-Glass Gold sold by Georgia Pacific and the Aquatough panel sold by United States Gypsum. The exterior panel may also be a magnesium oxide board such as the Dragon Board, the Magnum Board, the EagleBoard and other board sold by MgO.

The adjacent panels are positioned with either no gap or a small gap between them.

The mastic seam sealer is applied to the butt joint formed by two adjacent panels with a putty knife to the seam between the panels greater than the width of the first foundation tape will be placed into the mastic adhesive. Preferably, the mastic is a water-based high solids elastomeric acrylic sealant that can be easily troweled with a putty knife over most panel substrates curing into a protective rubberlike gasket over joints and seams.

The foundation tape is plastic, preferably a polyvinyl-chloride (PVC) tape that is semi rigid although other semi-rigid polymeric materials are satisfactory. The foundation tape is flat and lacks any longitudinal or embossed line of weakness along the top center segment to facilitate bending or folding. Moreover, the ability of the PVC foundation tape to adhere to the mastic is enhanced by gluing cotton or synthetic fibers to the surface of the PVC foundation tape. Further mechanical bond adherence to the taping compound is developed through the use of die cut perforations in the foundation tape allowing the adhesive mastic to ooze through and encapsulate the foundation tape. Preferably, the foundation tape is from 10-20 mils (preferably 12-14 mils) in thickness to provide sufficient rigidity to bridge gaps in wallboard installation while having enough flexibility to be packaged in rolls. It is also thin enough to minimize the weight of the tape and the amount of mastic needed to apply it.

The second tape in the disclosed dual-tape-core joint treatment system is a finish tape. The finish tape is a fabric, film or mesh/mat tape to which the mastic components of the disclosed panelized wall systems adhere, i.e., the mastic, ceramic spackle, primer coat and textured finish coating such as cement stucco coatings and latex-based cement-free texture coatings. Preferably, the finish tape material stretches and moves with the building panels while also providing added tensile strength to the mastic so as to provide a crack-free base for the finish coating. The composition of the finish tape may include, but are not limited to, cellulose papers, plastic films, metal foils, and woven or non-woven fabrics. The main function of the finish tape is to seal and anchor the edges of the foundation tape and provide a taper for the mastic to feather past the foundation tape and form a flat rubber-gasket like joint that is nonvisible beneath the textured finish coat. A preferred mesh thickness is from 4 to 10 mils thickness, preferably from 7-8 mils thick.

Building panels are positioned at right angles to create corners, columns, arches and other architectural designs on building exteriors. The edges created by the interfacing of the two panels creates an angle that is secured with corner beads. Corner beads may be constructed of galvanized metal, plastic, or composite tapes.

Both sides of the corner bead are sealed with a layer of mastic and reinforced with finish tape. A ceramic spackle is then applied over the cured mastic with embedded finish tape and floated out past the wings of the corner bead to create a smooth and flat corner profile that is then treated with a primer and finish coat.

BRIEF DESCRIPTION OF THE DRAWING FIGURE

A better understanding of the system and method for filling joints between exterior cement panels may be had by reference to the drawing FIGURE, wherein:

FIG. 1 is a perspective view of joint between exterior wall panels wherein the system and method of the present invention has been used to seal the space between the panels to provide a surface over which a wall finish may be applied.

DESCRIPTION OF THE EMBODIMENTS

Disclosed herein is a system for constructing, from substrate panels, walls with synthetic stucco finishes that resist cracking. Embodiments of the disclosed wall system are constructed from combinations of the components defined below.

Definitions

Joint. The term "seam", "joint" or "butt joint" as used herein refers both to a structure formed by the edges or corners of adjacent building panels, and a system of components used to fill or cover this structure. A joint, butt joint or seam is formed by two adjacent panels that may or may not have a gap between them, i.e., butted together, or with a gap between them (joint or seam). A moisture barrier is typically installed under the building panels.

Moisture Barrier. Moisture barriers are used in certain embodiments of the disclosed panelized wall systems. Any type of moisture barrier, also called water barriers and weather-resistive barriers, known in the art may be used, for example asphalt paper, polyethylene-based sheeting, reinforced plastic sheeting, or foam insulation panels. The moisture barrier is installed between the frame and the building panels.

Frame: As used herein, a frame is any frame capable of supporting the disclosed panelized wall system. Preferred frames are wood or metal frames. Preferably, the vertical members of the frame are spaced about 16" apart, up to about 24" apart or more, and optionally wrapped in a moisture barrier. Another preferred frame is a shear wall, a frame to which shear panels, typically plywood or oriented strand board (OSB) panels, are attached for reinforcement. Other examples of a suitable frame include a tilt-up wall, or a previously finished wall, such as wall finished with a cladding. Preferably, the building panels are positioned on the frame with the edges of adjacent panels sharing a common framing member, for example, a stud. In some embodiments, the panels are positioned with a gap of predetermined width between adjacent panels, the gap falling directly over a framing member. In another embodiment, the panels are installed without gaps, i.e., butted edge-to-edge. In embodiments with gaps between adjacent panels, the width of the gap is preferably from about 1/16" to about 1/8", allowing for building and panel movement, and shrinkage and expansion of the building panels. The bottom edges of the wall panels are preferably positioned on the wall level to ensure that the panels are level and plumb.

The building panels may be attached to the frame by any means known in the art. Mechanical means include nails, screws, staples, nuts and bolts, clips, and the like. The panels may also be fastened to the frame with chemical means, for example, with an adhesive or a tape. A predetermined pattern of fasteners is typically used to fasten the building panels to the frame. Preferred fasteners are screws and nails.

Building Panels. The building panels of the present application are made from substrates suitable for interior or exterior construction. The panels may be flat or embossed, and may also have textured surfaces. The substrate may be inorganic, organic, or a combination thereof. New age treated engineered wood panels are preferred especially for residential construction, such as the Smartside Precision Panels and Trim marketed by Louisiana Pacific. Other suitable building panels include fiber cement panels such as the WeatherBoard panels marketed by CertainTeed or the Hardie Panel marketed by James Hardie that can be either pretreated or untreated with a coating to modify water absorption through the panel face. Other suitable substrates may include glass mat reinforced cement boards, glass mat reinforced gypsum boards, and materials such as the Dens-Glass Gold panel marketed by Georgia Pacific and the Aquatough panel marketed by United States Gypsum. It will be appreciated, however, that the disclosed method may be applicable to other fiber reinforced inorganic substrates as well as other substrates, including but not limited to aluminum, other cement composites such as scrim board, wood, plywood, oriented strand board (OSB), wood composites, gypsum boards and plastics such as polymer foam composite panels such as expanded polystyrene foam.

The components of the disclosed embodiments of the invention have been selected to work best with the Treated Engineered Wood SmartSide brand marketed by Louisiana Pacific, that unlike fiber cement panels, is approved for single wall construction and can easily accommodate a tapered edge. It will be appreciated that similar components can be selected to achieve the same performance when used with building panels composed of other substrates.

Mastics. As described hereinafter, an adhesive layer is disposed between the building panel and the initial foundation tape. Elastomeric mastics having long elongation are preferred adhesives. Preferably, the elongation is greater than about 50%. A mastic layer preferably has a certain thickness that allows it to slip and distribute the movement of the panels to the entire primary and secondary tape materials, preventing cracking of the finish coat. Thicker and softer adhesive layers generally slip more easily, although the minimum thickness required to provide the desired slip characteristics will vary for each different adhesive. A preferred mastic layer thickness is from 1 mil to 40 mils. A thinner adhesive layer is easier for the finish to hide, however, and may be preferred to provide a superior finish. The mastic layer may be deposited in a single pass or several passes and include a single mastic or several mastics, for example, a dual mastic system.

The dual-tape-core joint treatment system disclosed herein uses an elastomeric mastic that distributes the movement of the panels to the entire primary and secondary tape material. The dual-tape-core joint treatment system also anchors the edges of the primary foundation tape by the secondary finish tape to the building panel, preventing the edges of the foundation tape from slipping. The mastic may be a pressure-sensitive or a non-pressure-sensitive mastic as in being putty knife applied. The latter class of mastic is particularly preferred. These mastics are normally tacky at room temperature and adhere to a surface by application of light finger pressure. In another embodiment, a hot-melt mastic may be preferred.

The mastic may include water-based, solvent-based, and 100% solid-based mastics. Preferred mastics include one-component and two-component compositions. The mastic may be based on, for example, general compositions of polyacrylate, polyvinyl ether, rubber (e.g., natural rubber), isoprene, polychloroprene, butyl rubber, neoprene rubber, ethylene propylene diene rubber (EPDM), polyisobutylene, butadiene-acrylonitrile polymer, thermoplastic elastomers, styrene-butadiene polymer, poly-alpha-olefin, amorphous polyolefin, silicone, ethylene-containing copolymer (e.g., ethylene vinyl acetate, ethylene ethyl acrylate, ethylene n-butyl acrylate, and ethylene methyl acrylate), polyurethane, polyamide, epoxy, polyvinylpyrrolidone and polyvinylpyrrolidone copolymers, polyesters, and mixtures or copolymers thereof. The mastic layer may also contain additives or modifiers, for example, tackifiers, plasticizers, fillers, antioxidants, stabilizers, pigments, curatives, cross linkers, solvents, etc. The preferred embodiment is a mastic that is a water-based high solids elastomeric acrylic sealant with typical properties of 66% solids by volume, 325 psi tensile strength and 200% elongation with a mixture by weight of Acrylic Polymer 54%, Calcium Carbonate 30%, Water 5%, isobutane 4%, titanium dioxide 2% and petroleum derivatives 2%.

It is expressly contemplated that the mastic layers can be applied either continuous, such as a uniform layer, or discontinuous, such as strips or brands, dots, or another patterned or random arrangement of discrete adhesive portions. The thickness of the mastic is controlled according to the requirements of the application.

Foundation Tape. The foundation tape is plastic, preferably a polyvinyl-chloride (PVC) tape that is semi-rigid although other semi-rigid polymeric materials are satisfactory. A preferred foundation tape is made from a PVC fiber composition material, for example the Crack-Tape composition tape marketed by Strait-Flex, Inc. The fibers are known as floc and can be nylon, rayon, Dacron, polyester, cotton, cellulose, or other similar fibers or combinations of fibers. The preferred fibers are cotton and nylon or combinations of nylon and cotton. The foundation tape is flat and lacks any longitudinal or embossed line of weakness along the top center segment to facilitate bending or folding. The ability of the PVC foundation tape to adhere to mastics is enhanced by gluing cotton or synthetic fibers to the surface of the PVC foundation tape. Nylon fibers or other water impervious fibers are used where a waterproof application is required. Further mechanical bond adherence to the taping compound is developed through the use of die cut perforations in the foundation tape allowing the adhesive mastic to ooze through and encapsulate the foundation tape. The perforations also allow for the escape of air pockets that tend to form during installation and also provide a visual cue as to whether there's sufficient mastic under the tape. The perforations are uniformly distributed throughout the tape or be allocated along the perimeter. The perforations may be circular, oblong, or angular with the number and size of the perforations such that they do not compromise the structural or semi-rigidness of the tape. Preferably, the foundation tape can be 8-20 mils, preferably 10-14 mils, in thickness to provide sufficient rigidity to bridge gaps in building panel installation while having enough flexibility to be packaged in rolls. It is also thin enough to minimize the weight of the tape and the amount of mastic needed to apply it. It is understood that other plastic tape compositions are suitable such as mineral filled polypropylene, Nylon/PVC and other polymeric combinations.

Finish Tape. The finish tape is a fabric, film or mesh/mat to which the mastic components of the disclosed panelized wall systems adhere, i.e., the mastic, ceramic spackle, primer coat and textured finish coating, particularly cement stucco coatings and latex-based cement-free texture coatings. Of these materials, a mesh is preferred. Preferred meshes are polyester, polypropylene, polyethylene, polyamide, cellulose, cotton, rayon, glass fiber, or combination of two or more of these materials. Preferably, the finish tape material has a selected moisture absorption characteristic that provides a monolithic appearance to the finish coat. The finish tape should adhere well to the mastic joint filler compounds and texture coatings of the disclosed panelized wall system. A preferred finish tape material is made from a nonwoven polyester mesh, for example, Bamilex Reinforced Spunbonded Polyester Mat tape which is marketed by Saint-Gobain which is constructed of spunbonded nonwoven polyester web reinforced with 5×5 yarns per inch mesh of 500 denier tenacity polyester with an average net weight of 2.1 ounces per square yard and 4-10 mils in thickness, preferably 7-8 mils thick.

A very thin reinforced polyester mesh is ideal for the finish tape. The main function of the finish tape is to seal and anchor the edges of the foundation tape and provide a taper for the mastic to feather past the foundation tape and form a flat rubber-gasket like joint that is invisible beneath the textured finish coat. Another function of the finish tape is to follow the shrinkage of the mastic as it cures forming a seal over the foundation tape especially over the edges of the foundation tape. A potential for edge creep by the foundation tape is ameliorated by the overlapping and anchoring of the edges of the foundation tape with the larger width finish tape thereby preventing cracking of the stucco or finish coat applied over the dual-tape-core joint treatment. Not unlike plastic wrap that is shrink wrapped with hot air over a basket, the finish tape is thin and strong yet pliable enough so as to provide similar benefits to the foundation tape as the adhesive shrinks during cure while at the same time providing a taper for the adhesive mastic to float the wall flat. A preferred width of the finish tape is from about 1" to about 12". In the construction field, a cost effective width of finish tape is from 2" to about 6", depending on the width of the foundation tape. The objective is for the finish tape to be wider than the foundation tape. For instance, if the foundation tape is 2 to 2¼" wide, an ideal width for the finish tape is 4". This about 2:1 width ratio of finish tape to foundation tape is necessary to accommodate alignment error in the field. Given that the foundation tape is covered and ideally hidden by mastic, completely covering the foundation tape with the finish tape may be problematic if the finish tape isn't evenly centered over the foundation tape. Hence, the finish tape should be significantly wider than the foundation tape to accommodate a varying degree of placement error when contractors are trying to align the finish tape over the center of the foundation tape.

Ceramic Spackle. Certain embodiments of the disclosed dual-tape-core joint treatment system include the use of an exterior ceramic spackle applied over a mastic that is encapsulated with a polyester reinforced mesh finish tape. Ceramic spackle is applied on any embossed building panel or trim edges or other edge profile defined with corner beads or trim on building panels. The ceramic spackle fills any depressions in the corner bead areas, providing a smooth surface for the textured finish coat. The ceramic spackle, unlike the mastic, doesn't contain elastomeric properties but rather is designed to provide a surface that is sandable, non-shrinking, high-fill and easily spreadable that is also weather resistant, once dry and cured. The ceramic spackle is preferably a mixture that includes a polymer binder, one or more inorganic fillers, thickeners, pigments, and inorganic binders.

Polymer latex emulsions such as acrylic emulsions are well known in the art and are suitable as the elastomeric polymer binder. Other suitable polymer binders include re-dispersible powdered acrylics, styrene-acrylics and polyurethanes.

Inorganic binders can be used in the ceramic filler material to provide hardness and scratch resistance. One example of a suitable inorganic binder is soda lime borosilicate glass, calcium carbonate, kaolin clay, aluminosilicate, and other silicate minerals are examples of suitable inorganic fillers, and are well known in the art. The inorganic filler may also be a low-density expanded mineral such as perlite. Hollow aluminosilicate or polymeric microspheres are examples of inorganic fillers that both modify the density of the joint filler and control the expansion and contraction characteristics.

Suitable thickeners are well known in the art and include cellulose ethers, vegetable gums, clays, and synthetic polymers such as ammonium salts of acrylic polymers. Pigments may be white, for example titanium dioxide, kaolin clay, or calcium carbonate, or colored, for example iron oxides. Pigments suitable for coloring the ceramic spackle are well known in the art.

The ceramic spackle may be applied over the mastic and the finish tape by any method known to the art, for example by using a putty knife or trowel. It has been described in prior art that a ceramic joint filler, may be applied in one or more thin layers in order to minimize the visibility of the joint. However, it has been discovered that the ceramic joint filler is subject to cracking that will telegraph through to the textured finish coat. This is detrimental to the goal of creating a panelized wall system utilizing a joint tape that resists cracking.

In one embodiment, however, the ceramic spackle is especially useful to smooth and level corner bead trim on outside corners, columns and arches whose panel edges are fitted with corner beads. In another embodiment, pre-treating the corner bead wings with mastic and finish tape, provides a ribber gasket like sealant to prevent moisture from migrating through the corner bead should the ceramic spackle crack become damaged.

The thickness of the ceramic spackle application depends on the depth of the corner beads and other edge features on the panels. Once applied, the ceramic spackle is typically allowed to cure (harden) for several hours, depending on temperature and relative humidity. After curing, the ceramic spackle, as an option, may be smoothed very fine by sanding. A preferred ceramic spackle contains by weight acrylic copolymer emulsion (30%), hydrated aluminum silicate mineral (19.5%), soda lime borosilicate glass (10%), kaolin clay (8%), titanium dioxide (4%), and ammonium salt of acrylic polymer (1%).

Primer. A primer coating that is applied to the entire wall assembly using a paint roller or airless spray and allowed to dry 1 to 2 hours, provides a surface with uniform absorption properties and uniform color that matches the textured stucco finish coat. The primer coating is typically a high quality, water-based acrylic-epoxy coating designed to enhance bonding to multiple substrates and increase its abrasion resistance. A special spherical silica sand is suspended in the textured version to provide a fine uniform nonskid finish that enhances the trowel application of texture top coats on smooth, slick vertical substrates with the following properties: 52% solids by volume, >200° F. (93° C.) flash point, 30 minutes to touch dry time and 1-2 hours for re-coat or application of a textured finish coat. Another primer is a high performance elastomeric acrylic with the following properties: 55% solids by volume, 150 psi tensile strength at 75° F. and 400 psi at 0° F.; 300% elongation at 75° F. and 400% elongation at 0° F. The elastomeric acrylic primer effectively covers existing hairline cracks and bridges hairline cracking caused by further building movement. Other known elastomeric or non-elastomeric primers, finish coats, water based or solvent are well known in the art and generally contain a polymer binder, inorganic filler, water and pigments, are also be suitable.

Stucco Finish Coating. One possible finish is a textured finish simulating stucco, selected for its water resistance and flexibility. This type of finish is referred to as "synthetic stucco" or simply "stucco." Such finishes are well known in the art and are generally contain a polymer binder, inorganic filler, water, and pigments. Texture coatings are generally applied with a hopper or trowel in one or more coats. Various exterior textures finishes can be applied to the exterior building panel depending on the aggregate mix and the application technique. If synthetic stucco is used, the synthetic stucco cures to a stone-like veneer providing added durability to the underlying panel. Furthermore, the system and method of the present invention provides independent elastomeric properties in the underlying acrylic primer and the components in the dual-tape-core joint treatment system to synergistically work together to provide enhanced system flexibility and durability.

The present invention describes an improved system and method for preparing and finishing exterior building wall panels, in various stud compositions and panel attachments using a dual-tape-core joint treatment system with cement and cement-free wall coatings and finishes. The dual-tape-core joint treatment system disclosed herein describes two individual tapes applied individually acting synergistically. However, similar benefits may be achieved by the manufacture of both tapes as a single entity and applied in a single pass by those skilled in the art without departure from the spirit and scope of this invention.

The invention as shown in FIG. 1 describes an application process that prepares exterior building panels 102, similar to interior gypsum drywall, for the purpose of creating a smooth surface for the application of exterior stucco or painted finish. Exterior engineered wood panels such as the Smartside panels marketed by Louisiana Pacific and other previously described building panels are first secured to the building frame 104 per manufacturer's guidelines. The spaces 106 between the panels 102 are then filled and effectively made to disappear by use of the disclosed dual-tape-core joint treatment system and method 10.

This disclosed system and method 10 enables the creation of stucco like finishes with greater strengths and benefits not present in typical stucco or prior art exterior insulation finish systems. This disclosed system and method 10 may be best understood by those of ordinary skill in the art of drywall, painting and plaster, making use of a tape and float system that integrates the skills, techniques and materials from heretofore unrelated areas to create a smooth base for stucco-like finishes and textures.

Like drywall, exterior wall panels 102 are mounted on an exterior building frame 104 with the adjacent edges of the panels butted together or lightly gapped to form a space 106 there between. An optional weep screed termination 108 at the base of each panel 102 over the foundation 110 provides a level line, a drainage plane and corner bead like protection. In the preferred embodiment of the invention, once the exterior building panels 102 are mounted to the building frame 104, an acrylic flexible joint compound or mastic 20, is applied with a 4-6 inch putty knife over the center of the butt joint or seam 106 to fill the butt joint or seam 106. A perforated 2-2¼ inch wide, semi-rigid, PVC fiber composite foundation tape 30, is then embedded into the wet mastic 20 allowing the mastic to ooze through the perforations 32 and thoroughly encapsulate the foundation tape 30. A first cover coat of mastic 40 is then applied with a larger 6-9 inch putty knife over the foundation tape 30 to prepare a mastic bed for the application of finish tape 50, a 4 inch thermally set, spunbonded polyester nonwoven joint tape reinforced with a 5×5 polyester scrim pattern 52. The finish tape 50 is then centered over and overlapping the 2-2¼ inch foundation tape 30 so as to prevent edge creep or hairline cracking from telegraphing through the stucco finish coat. Moreover, the larger width and thinner diameter of the finish tape 50 also provides a platform to taper the disclosed dual-tape-core joint treatment system 10. By floating a second cover coat 60 of the mastic 9-12 inches on both sides of the joint or seam, like drywall, will assist in helping level the dual-tape-core joint treatment and flatten the overall wall profile.

To treat corner beads, arches and columns, it has been discovered that a ceramic spackle, is ideal. As previously described, once the thermally set spunbonded, reinforced, polyester, non-woven finish tape 50 has been set into the second coat of the mastic 40 it is smoothed and allowed to dry over the wings of the corner beads. Once dry, a ceramic spackle is then applied. Floating and feathering of the corner beads, as well as on columns, arches and other architectural panel details, is a preferred embodiment. As the ceramic spackle is formulated with acrylic resins, it provides a strong bond and cures with the underlying acrylic flexible joint compound. When dry, the ceramic spackle may be sanded if required, providing an extremely smooth, flat surface for the application of the acrylic elastomeric coating that follows.

A preferred acrylic-epoxy, roller applied, color matching scratch coat 202 is then applied over the entire exterior building panels 102, corner beads, and the dual-tape-core treated joints. The acrylic-epoxy with spherical sand suspended, provides a non-skid finish for the textured finish coat 204 to grab to like the function of a cement-based scratch coat. A preferred alternative embodiment is an elastomeric coating that can also be tinted the same color as the textured exterior finish topcoat which is either spray-applied, rolled or brushed onto the exterior of the building. In actual applications, it has been observed that the acrylic elastomeric coating, cures to a soft acrylic rubber-like substance with excellent freeze/thaw properties such that the colder it gets, the more elastomeric it becomes. The acrylic elastomer coating is a mixture by weight of acrylic polymer 43%, calcium carbonate 36%, water 11% titanium dioxide 5%, and calcium carbonate 3%.

A final textured or non-textured coating is then applied onto the wall with a hopper gun, troweled or rolled. Various exterior textures can then be applied to the previous scratch coat or elastomeric primer depending on the aggregate mix and the application technique. If synthetic stucco is used, the synthetic stucco cures to a stone-like veneer providing added durability to the exterior building panels. This type of finish is referred to as "synthetic stucco" or simply "stucco." Such finishes are well known in the art and are generally contain a polymer binder, inorganic filler, water, and pigments. An optional trimband 206 may then be placed over the textured finish coat near the foundation 110.

The embodiments illustrated and described above are provided as examples of certain preferred embodiments of the present invention. Various changes and modifications can be made to the embodiments presented herein by those skilled in the art without departure from the spirit and scope of this invention, the scope of which shall be limited only by the claims appended hereto.

I claim:

1. A system for sealing the space between exterior wall panels, said system comprising:

A mastic placed in the space between the exterior wall panels and coating a portion of the exterior surface of the exterior wall panels;

A single, semi-rigid, PVC composite fiber, perforated foundation tape, having a length and width, placed over and within the extents of said applied mastic;

Wherein said perforations allow the underlying mastic to flow through the semi-rigid, PVC composite fiber, perforated foundation tape when pressure is applied thereon;

A first mastic layer placed over and extending beyond the width of said single, semi-rigid, PVC composite fiber, perforated foundation tape;

An elastomeric, sealing finish tape having a width greater than said single, semi-rigid, PVC composite fiber, perforated foundation tape placed over said first mastic layer; and A second mastic layer placed over and extending beyond the extents of said elastomeric, sealing finish tape.

2. The system as defined in claim 1 wherein the ratio of the width of said elastomeric, sealing finish tape to said semi-rigid, PVC composite fiber, perforated foundation tape is about 2:1.

3. The system as defined in claim 1 wherein said mastic is an elastomeric acrylic sealant.

4. The system as defined in claim 1 wherein said semi-rigid, PVC composite fiber, perforated foundation tape further includes fibers glued to the exterior surface thereof.

5. The system as defined in claim 1 wherein said elastomeric, sealing finish tape is selected from a group including: fabric, film, or a mesh/mat.

6. A method for sealing the space between exterior wall panels, said method comprising the steps of:

Filling the space between the exterior wall panels and coating a portion of the exterior surface of the exterior wall panels with mastic;

Placing a single, semi-rigid, PVC composite fiber, perforated foundation tape, having a length and width, over and within the extents of said applied mastic;

Wherein said perforations allow the underlying mastic to flow through the semi-rigid, PVC composite fiber, perforated foundation tape when pressure is applied thereon;

Covering said single, semi-rigid, PVC composite fiber, perforated foundation tape with a first mastic layer, wherein the mastic layer extends beyond the width of said foundation tape;

Placing an elastomeric, sealing finish tape having a width greater than said single, semi-rigid, PVC composite fiber, perforated foundation tape over said first mastic layer;

Covering said elastomeric, sealing finish tape with a second mastic layer wherein said second mastic layer extends beyond the extents of said finish tape.

7. The method as defined in claim 6 wherein the ratio of the width of said elastomeric, sealing finish tape to said semi-rigid, PVC composite fiber, perforated foundation tape is about 2:1.

8. The method as defined in claim 6 wherein said mastic is an elastomeric acrylic sealant.

9. The method as defined in claim 6 wherein said semi-rigid, PVC composite fiber, perforated foundation tape further includes fibers glued to the exterior surface thereof.

10. The method as defined in claim 6 wherein said elastomeric, sealing finish tape is selected from a group including: fabric, film, or a mesh/mat.

11. A two-layer tape for use over the space between exterior wall channels wherein the space between the exterior wall panels has been filled with and the surface of the panels has been covered with a mastic, said two-layer tape comprising:

A single, semi-rigid, PVC composite fiber, perforated foundation tape layer, having a length and width;

An elastomeric, sealing finish tape layer having a length and width, wherein said width of said elastomeric, sealing finish tape being greater than the width of said single, semi-rigid, PVC composite fiber, perforated foundation tape layer;

Wherein said elastomeric, sealing finish tape layer is laid over and attached to said single, semi-rigid, PVC composite fiber, perforated foundation tape layer such that the length dimensions of each layer are substantially parallel to one another;

Whereby when said two-layer tape is placed over the mastic filling the space between and covering the surface of the exterior wall panels, the mastic will pass through the perforations in said single, semi-rigid, PVC composite fiber, perforated foundation tape layer and contact the overlying elastomeric, sealing finish tape layer.

* * * * *